United States Patent [19]

Loitz

[11] Patent Number: 4,605,311

[45] Date of Patent: Aug. 12, 1986

[54] ELECTRONIC WATCH HAVING A STEPPING MOTOR

[75] Inventor: Jürgen Loitz, Rheinfelden, Switzerland

[73] Assignee: Aline Loitz-Triebold, Rheinfelden, Switzerland

[21] Appl. No.: 727,252

[22] Filed: Apr. 24, 1985

[30] Foreign Application Priority Data

Oct. 2, 1984 [CH] Switzerland ..... 4725/84

[51] Int. Cl.[4] ..... G04B 19/20; G04B 19/06

[52] U.S. Cl. ..... 368/77; 368/233

[58] Field of Search ..... 368/76, 77, 80, 157, 368/160, 223, 228, 229, 232–234

[56] References Cited

U.S. PATENT DOCUMENTS

| | | | |
|---|---|---|---|
| 2,791,853 | 5/1957 | Coons et al. | 368/229 |
| 2,988,870 | 6/1961 | Tupone | 368/229 |

FOREIGN PATENT DOCUMENTS

| | | | |
|---|---|---|---|
| 865876 | 2/1953 | Fed. Rep. of Germany | 368/233 |
| 57-163891 | 10/1982 | Japan | 368/229 |
| 177973 | 6/1935 | Switzerland | 368/233 |
| 316845 | 10/1956 | Switzerland | 368/233 |

*Primary Examiner*—Vit W. Miska

*Attorney, Agent, or Firm*—Spencer & Frank

[57] ABSTRACT

The rotor of a stepping motor which rotates quickly by 180° after the elapse of every second is provided with an ornamental disc at the end of the rotor spindle that is directed toward the timepiece's face. The disc may be disposed above the face, where it must be arranged in such a manner that it does not interfere with the paths of the hands. Alternatively, the disc may lie below the face, with at least one window being provided in the face so as to expose part of the disc. The design on the disc is such that the portion visible in the window changes suddenly every second. For example the design on the disc may be formed of two halves of contrasting color, one of which may be a luminescent color, a fluorescent color, or a luminous color. The device then has the same effect as a blinking light.

10 Claims, 11 Drawing Figures

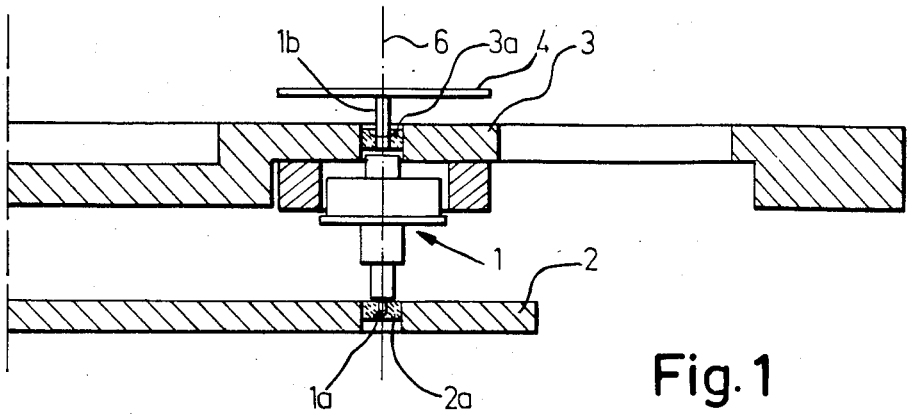
Fig. 1
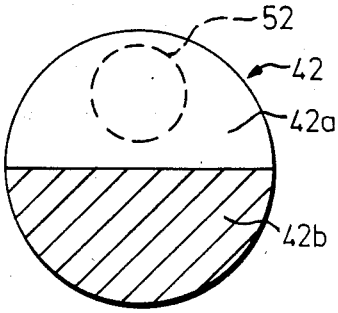
Fig. 2
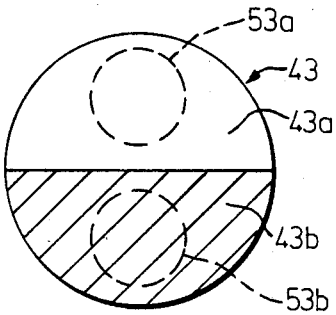
Fig. 3
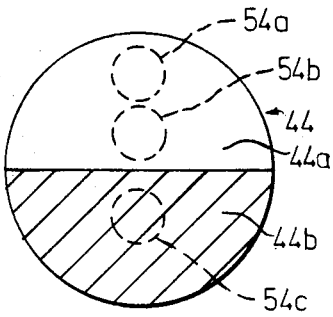
Fig. 4
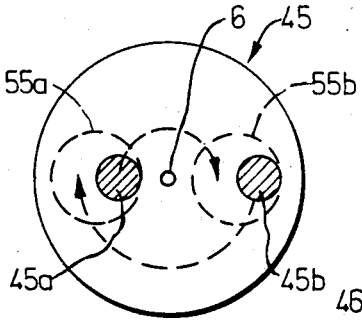
Fig. 5
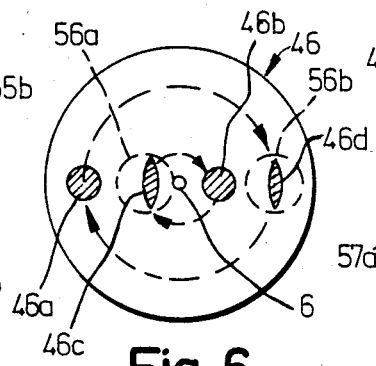
Fig. 6
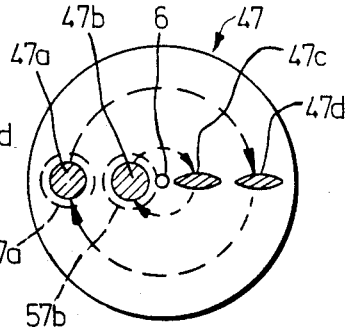
Fig. 7
Fig. 11
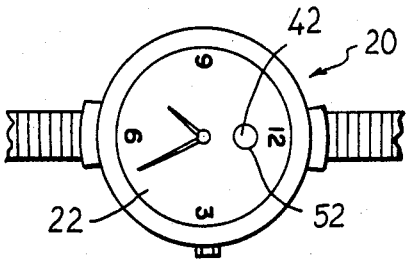

ELECTRONIC WATCH HAVING A STEPPING MOTOR

BACKGROUND OF THE INVENTION

The present invention is directed to an electrical timepiece, and more particularly to an electric watch with moving ornamentation.

Children's watches with faces that are provided with some sort of drawing having movable parts, for example a face with moving pupils, are already known. These known watches are mechanical, with the moving parts being seated on the axis of the escapement mechanism, and consequently perform a relatively slow movement of approximately 15° every fifth of a second. Electronic timepieces such as watches that employ stepping motors have no parts that perform a movement every fifth of a second, so that in the past electronic watches with stepping motors have not been designed to include movable figures on their faces.

SUMMARY OF THE INVENTION

The present invention relates to a movable ornamented electronic timepiece which has a stepping whose rotor rotates suddenly by 180° every second. The watch of the present invention is characterized in that the rotor shaft, at the end thereof which is directed toward the face of the timepiece, is provided with an ornamental disc disposed directly below or above the face. If the disc is disposed above the face, the face is provided with an opening for the rotor shaft, and if the disc is disposed below the face, the face is provided with at least one window for viewing part of the disc. In the latter case, the design on the disc includes color and/or drawings in such a manner that the section visible through the window changes suddenly every second.

Against all expectations, effects are produced with such a construction which, as can easily be determined subsequently, are significantly superior to the effects of the prior art moving pictures in mechanical timepieces.

In mechanical timepieces equipped with parts which move every fifth of a second, the observer always sees something move because the motion is relatively slow and the path is short, but due to the speed of the movement, on the one hand, and the short period of standstill, on the other hand, the observer has no opportunity to actually see the entire moving image. This is completely different in the present invention. Here, movement is so quick that, depending on the design of the timepiece, it may not be noticed at all; the image appears to the observer to be a still image which is suddenly replaced by another image and, particularly if the image is viewed only through a window in the watch face, the observer is unable to determine to which side the image has moved away.

BRIEF DESCRIPTION OF THE DRAWINGS

FIG. 1 is a side view, partially in section, schematically illustrating the rotor of a stepping motor mounted in a timepiece housing, and an ornamental disk attached to the shaft of the rotor.

FIG. 2 is a top view of an ornamental disc and shows, in dashed lines, the outline of the window in the face disposed above the disc.

FIGS. 3 and 4 are top views of the same ornamental disc, but with two or three, respectively, windows in the face.

FIGS. 5 through 7 are top views of another ornamental disc and show the outlines of two windows in the face disposed thereabove.

FIG. 11 is a top view of a watch employing the ornamental disc of FIG. 2.

DESCRIPTION OF THE PREFERRED EMBODIMENTS

Figure 8:
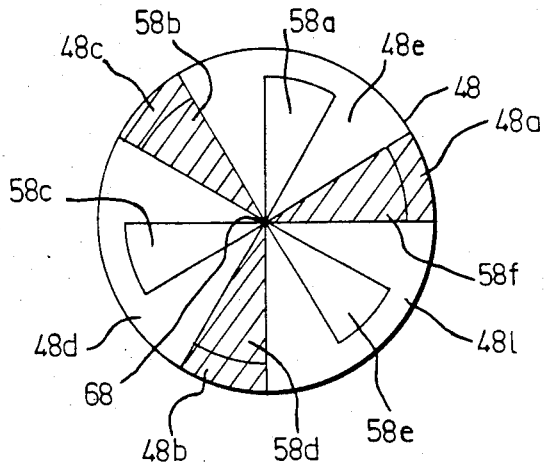
FIGS. 8, 9 and 10 are three further top views of different ornamental discs, with, however, the windows in the face disposed thereabove being drawn in continuous solid lines.

In FIG. 1 a timepiece housing includes a first plate 2 oriented away from the face (not illustrated) of the timepiece and a second plate 3 oriented toward the face. A stepping motor having a rotor, marked 1 as a whole, is mounted between plates 2 and 3. Rotor 1 is provided with a spindle 1*a* mounted in a bearing 2*a* of plate 2. The other end of rotor 1 is provided with a spindle 1*b* which extends through a bearing 3*a* in plate 3. Rotor 1 performs a quick 180° rotation every second.

An ornamental disc 4, which may be circular, is seated on the end of spindle 1*b*. However, disc 4 may also have any other shape, it being advisable, however, for its center of gravity to coincide with the center of rotation. The length of spindle 1*b* is either such that disc 4 is disposed directly above the face without, however, contacting it and without interfering with the path of the hands, or the length is such that disc 4 is disposed directly below the face, likewise without contacting it. In the former case, the face must be provided with an opening for the spindle 1*b*, and in the latter case, the face must be provided with at least one window so that a section of the disc surface and of the design applied thereto is visible through the window(s).

FIGS. 2 through 10 show several embodiments of the design on an ornamental disc disposed below the face and the positions of the respective windows in the face. The windows are illustrated using dotted lines in FIGS. 2–7 but, due to the more complex window configurations in FIGS. 8–10, solid lines are employed to show the windows in these latter Figures in order to facilitate illustration.

Disc 42 of FIG. 2 is provided with two differently colored disc halves 42*a* and 42*b*. The face is provided with an opening or window 52 so that, depending on the position of rotor 1, one or the other of the colors is visible. Since the disc revolves relatively quickly by 180° after the elapse of every second, it is not possible to discern the change from one colored surface to the other; window 52 shows only a sudden change in color. Two contrasting colors are suitable for the disc 42. However, one disc half 42*a* or 42*b* may also be provided with a fluorescent, luminescent, or luminous color and the other disc half may be given the color of the face. Then the effect will be the same as if a luminous dot were switched on and off.

FIG. 11 illustrates a watch 20 having a face 22 with an opening 52 which exposes disc 42, disc 42 being rotatably mounted beneath face 22.

If two openings or windows 53*a* and 53*b* are provided in the watch face, as shown in FIG. 3, and if one half of disc 43 (that is, disc half 43*a* or 43*b*) is again the same color as the face and the other half is provided with a contrasting color or a fluorescent, luminescent, or luminous color, an effect will be produced as if two lights were alternatingly switched on and off, as is customary, for example, for display boards in airports. If, in a disc 44 of the same design and having disc halves 44*a* and 44*b*, the face is provided with three apertures or windows 54*a*, 54*b*, 54*c*, as shown in FIG. 4, there will appear to be an alternate "blinking" of one and two light dots.

FIGS. 5 through 7 show different designs for the ornamental disc. These designs are particularly suitable for trendy watches, but also for a child's watch in which the face is provided with a picture having moving parts, i.e., the face of a human being or animal and two eyes which move. In the embodiment shown in FIG. 5, the face has two windows 55*a* and 55*b* whose center points are disposed on a straight line which intersects the geometric axis 6 of rotor 1. The ornamental disc 45 is light-colored and has two dark spots 45*a* and 45*b*. Spots 45*a* and 45*b* are located at different distances from axis 6 so that, when seen through windows 55*a* and 55*b* when disc 45 is positioned as shown in FIG. 5, they are somewhat to the right of the centers of the windows. The result of this is that after rotation of disc 45 by 180°, the windows through which dark spots 45*a* and 45*b* appear are switched and the spots 45*a* and 45*b* are positioned to the left of the center of windows 55*a* and 55*b*. Due to the sudden and discontinuous rotation of disc 45, the movement of spots 45*a* and 45*b* from window to window is not discernible. Only the old and new positions are detected, thereby creating the impression that the spots move around within the windows.

In the embodiment shown in FIG. 6, the face also has two windows, which are here marked 56*a* and 56*b*. Windows 56*a* and 56*b* are positioned so that a line through their centers intersects the geometrical axis 6 of the rotor 1. While in the embodiment of FIG. 5 the two windows 55*a* and 55*b* are arranged symmetrically with respect to the rotor axis 6, in the embodiment according to FIG. 6 the windows 56*a* and 56*b* are spaced unequally far from the geometric axis 6 of the rotor. The distance between axis 6 and the near edge of window 56*b* is at least as large as the distance between axis 6 and the far edge of window 56*a*. Here, ornamental disc 46 is provided with two different spot designs for each window, offset by 180°, i.e., round spot designs 46*a* and 46*b* and elongate spot designs 46*c* and 46*d*. When rotor 1 rotates by 180°, both round spot designs 46*a* and 46*b* or both elongated spot designs 46*c* and 46*d* suddenly appear in the windows so that here again it is possible to equip a picture with moving eyes.

Both windows may be arranged on the same side of geometric axis 6, as shown in FIG. 7, thereby facilitating artwork on the timepiece's face by bringing the windows closer together. In FIG. 7, the two windows are marked 57*a* and 57*b*, the disc is marked 47, and the design spots are marked 47*a*, 47*b*, 47*c*, and 47*d*. Of course, other indicia can be used for the design spots; not just eyes, but also hands, fingers, flags, leaves, and anything else that can move in any way.

In the embodiment of FIG. 8, disc 48 is arranged below a face which is provided with six windows 58*a*, 58*b*, 58*c*, 58*d*, 58*e*, and 58*f* that are arranged uniformly around a center point 68 disposed on geometric axis 6 of the rotor shaft. Ornamental disc 48 itself has two colors. Three color fields 48*a*, 48*b* and 48*c* of one color alternate with three color fields 48*d*, 48*e* and 48*f* of the other color. With every rotation of ornamental disc 48 through 180°, the color changes in every field. One of the colors may here be the color of the face of the timepiece.

Figure 9:
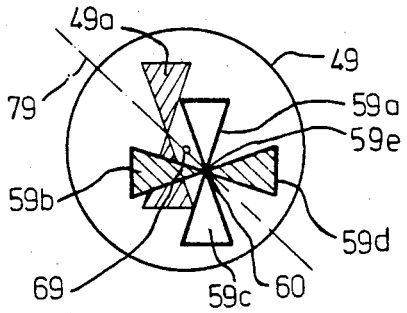

In the embodiment of FIG. 9, ornamental disc 49 is likewise disposed below the face. The latter has four windows 59*a*, 59*b*, 59*c*, and 59*d*, which are arranged uniformly around a center point 59*e* and, in the illustrated embodiment, form a Maltese cross. The four windows may also be separate from one another. The center of ornamental disc 49, i.e., the geometric axis 6 of the rotor 1, is marked 69 and does not coincide with center point 59*e*. Center 69 of the disc 49 lies on a straight line 79 which separates the four windows 59*a*, 59*b*, 59*c*, and 59*d* into two mirror-image groups of openings without intersecting any of the four openings. Ornament 49*a* on ornamental disc 49 is composed of four individual color spots; two of them are visible, in the illustrated position of disc 49, through openings 59*b* and 59*d*. Their center point 60, in the illustrated position of disc 49, lies underneath the center 59*e* of the four windows. The other two color spots are symmetrical with the other two openings 59*a* and 59*b* with respect to the center 69 of disc 49 and are configured in such a manner that, in the illustrated position of the disc, they do not lie underneath openings 59*a* and 59*c*. In this way it is possible for a 180° rotation of disc 49 to create the impression that the color spots visible in the opening rotate around the center of the openings, each by 90°.

Figure 10:
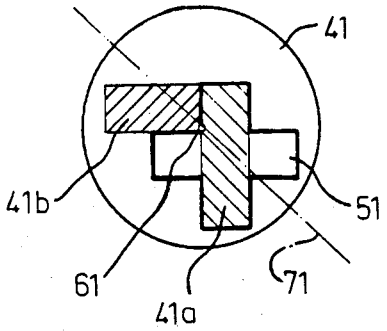

In the embodiment of FIG. 10 as well, the ornamental disc, here marked 41, is disposed below the face of the timepiece. The face is provided with a cross-shaped window 51 and the center 61 of disc 41 does not coincide with the center of cross 51 but lies outside of the opening on a line 71 diagonal to the opening. Ornamental disc 41 here is provided with an L-shaped ornament having a leg 41*a* that extends below a bar of the cross while the other leg 41*b* is associated symmetrically with the other bar of the cross, the point of symmetry being the disc center 61, which lies on the geometric axis 6 of the rotor. In this arrangement as well, rotation of the disc by 180° produces an effect corresponding to that produced when the center of cross bar 41*a* rotates about 90°.

If the ornamental disc is arranged above the face so that the face is not visible as a whole, the disc may bear a design shaped as a signet or it may be the same color as the face and have a signet in contrasting color, it only being necessary to take care that such a signet still has a decorative effect once it has been rotated by 180° from its starting position.

It will be understood that the above description of the present invention is susceptible to various modifications, changes and adaptations, and the same are intended to be comprehended within the meaning and range of equivalents of the appended claims.

What is claimed is:

1. An electronic watch, comprising:

a watch face having at least one window therein;

a stepping motor with a rotor which rotates suddenly by about 180° after the elapse of every second, said rotor having a shaft that is oriented toward said face; and an ornamental disc mounted on said shaft and disposed directly below said face, said ornamental disk having a plurality of visually distinguishable regions that are disposed so that regions exposed by said at least one window change suddenly every second.

2. A watch as defined in claim 1, wherein said face has only one window, and wherein said visually distinguishable regions include two different colored sectors disposed so that, in one position of said rotor, one color is exposed by said window and, when said rotor rotates by 180°, the other color is exposed by said window.

3. A watch as defined in claim 2, wherein said one color is a fluorescent or luminescent or luminous color.

4. A watch as defined in claim 1, wherein said rotor has a geometric axis, wherein said face has at least two windows, each window having a center, wherein said windows are disposed so that the centers thereof lie on a straight line which intersects said geometric axis, and wherein said visually distinguishable regions include two different color sectors, one of which is provided with a fluorescent or luminescent or luminous color.

5. A watch as defined in claim 1, wherein said rotor has a geometric axis, wherein said face has two windows which are disposed symmetrically with respect to said geometric axis of said rotor, and wherein said visually distinguishable regions include figures positioned so that each window reveals a suddenly moving change of location of a figure.

6. A watch as defined in claim 1, wherein said rotor has a geometric axis, wherein said face has two windows which are located at different distances from said geometric axis of said rotor, each window having a center, wherein said windows are disposed so that the centers thereof lie on a straight line intersecting said geometric axis, wherein the distance between said geometric axis and the nearest point of the window that is farthest from said geometric axis is at least as large as the distance between said geometric axis and the farthest point of the window that is nearest said geometric axis, and wherein said visually distinguishable regions include figures for each window offset by 180°.

7. A watch as defined in claim 1, wherein said rotor has a geometric axis, wherein said face has six windows which are uniformly distributed about a center point lying on said geometric axis of said rotor, and wherein said visually distinguishable regions include three fields of a first color and three fields of a second color, the fields of said first color alternating with those of said second color.

8. A watch as defined in claim 1, wherein said rotor has a geometric axis, wherein said face has four windows which are distributed uniformly around a center point that is spaced apart from said geometric axis, and wherein a straight line running through said geometric axis and center point separates said four openings into two mirror-image groups of openings, without intersecting any of said four openings.

9. A watch as defined in claim 1, wherein said rotor has a geometric axis, wherein said face has a cross-shaped window, said window having a central rectangular portion and four peripheral portions communicating with said central rectangular portion, and wherein said geometric axis of said rotor is intersected outside said window by a diagonal of said central rectangular portion.

10. An electronic watch, comprising:

a watch having a face with an opening therein;

a stepping motor with a rotor which rotates suddenly by about 180° after the elapse of every second, said rotor having a shaft which extends through said opening; and an ornamental disc mounted on said shaft and disposed directly above said face.

* * * * *